US010129936B2

(12) United States Patent
Carlsson et al.

(10) Patent No.: US 10,129,936 B2
(45) Date of Patent: Nov. 13, 2018

(54) MICROWAVE HEATING APPARATUS WITH DUAL LEVEL CAVITY

(71) Applicant: Whirlpool Corporation, Benton Harbor, MI (US)

(72) Inventors: Hakan Carlsson, Norrkoping (SE); Juan Chen, Norrkoping (SE); Fredrik Hallgren, Kolmarden (SE); Ulf Nordh, Norrkoping (SE); Patrik Rydin, Skarblacka (SE)

(73) Assignee: Whirlpool Corporation, Benton Harbor, MI (US)

( * ) Notice: Subject to any disclaimer, the term of this patent is extended or adjusted under 35 U.S.C. 154(b) by 832 days.

(21) Appl. No.: 13/716,769

(22) Filed: Dec. 17, 2012

(65) Prior Publication Data

US 2013/0153570 A1 Jun. 20, 2013

(30) Foreign Application Priority Data

Dec. 16, 2011 (EP) ..... 11194095

(51) Int. Cl.
*H05B 6/64* (2006.01)
*H05B 6/80* (2006.01)
*H05B 6/70* (2006.01)

(52) U.S. Cl.
CPC ..... *H05B 6/6402* (2013.01); *H05B 6/70* (2013.01); *H05B 6/80* (2013.01); *H05B 2206/044* (2013.01)

(58) Field of Classification Search
CPC .. H05B 2206/044; H05B 6/6402; H05B 6/70; H05B 6/80
USPC ..... 219/702, 745, 756, 762–763
See application file for complete search history.

(56) References Cited

U.S. PATENT DOCUMENTS 4,289,945 A * 9/1981 Kristof ..... H05B 6/725 219/745
6,884,979 B1 * 4/2005 Torngren et al. ..... 219/746
2004/0004074 A1 * 1/2004 Torngren ..... H05B 6/686 219/678
2008/0087662 A1 * 4/2008 Takizaki et al. ..... 219/678
2010/0155392 A1 * 6/2010 Nordh ..... H05B 6/68 219/702
2010/0176123 A1 * 7/2010 Mihara ..... H05B 6/705 219/746
2010/0252551 A1 * 10/2010 Nordh ..... H05B 6/74 219/702
2011/0266463 A1 * 11/2011 Einziger ..... H05B 6/6402 250/492.1

* cited by examiner

*Primary Examiner* — Michael G Hoang

(57) ABSTRACT

The present disclosure relates to a microwave heating apparatus and method of heating a load using microwaves. The microwave heating apparatus comprises a cavity dividable into at least two compartments, a first microwave generator and a first feeding port for feeding a first mode field in a first compartment of the cavity, a second microwave generator and a second feeding port for feeding a second mode field in a second compartment of the cavity. The first mode field and the second mode field provide complementary heating patterns in the cavity when the cavity is undivided. The present disclosure provides the flexibility of heating a load in a large cavity or heating a plurality of loads in smaller compartments of the cavity while still providing even heating in the cavity and in the compartments.

19 Claims, 6 Drawing Sheets

MICROWAVE HEATING APPARATUS WITH DUAL LEVEL CAVITY

CROSS-REFERENCE TO RELATED APPLICATIONS

This application claims priority to European Patent Application No. 11194095.3 filed 16 Dec. 2011 which is hereby incorporated by reference in its entirety.

TECHNICAL FIELD

The present relates to the field of microwave heating, and in particular to a microwave heating apparatus for heating a load by means of microwaves.

BACKGROUND

Traditional microwave ovens usually comprise a single cooking chamber in which a food item "to be heated", or "to be reheated", is placed. The number of meals that can be prepared at the same time in such traditional microwave ovens is however limited and, for most users, not sufficient. In traditional microwave ovens having a single cooking chamber, reheating of a ready meal for a family of e.g. four persons can take a lot of time (up to twenty minutes depending on the type of dishes) and, in addition, the four dishes are ready successively, i.e. not at the same time. There is therefore a general need for microwave ovens in which it is possible to prepare several dishes at the same time and more rapidly.

In for example U.S. Pat. No. 5,796,082, a microwave oven including a cooking chamber in which a plurality of removable horizontal partition plates are mounted to divide the cooking chamber into vertically adjacent compartments is disclosed. In this prior art, a tray is rotatably mounted on each partition plate and a drive shaft carries vertically spaced drive elements, such as friction wheels or gears, which are engageable with respective trays. The trays become disengaged from the drive elements in response to being removed from the cooking chamber. An additional driven tray is mounted on a floor of the cooking chamber. Such a prior art microwave oven relies on dispersing the microwaves by the rotation of a tray provided to each one of the cooking compartments. A drawback of such prior art is the need of turntables and rotating parts, which increase the complexity and cost of the apparatus. Further, such prior art microwave ovens do not provide a satisfactory heating evenness in each one of the cooking chambers.

Thus, there is a need for providing new apparatus and methods that would address at least some of the above mentioned issues.

SUMMARY

An object of at least some of the embodiments of the present disclosure is to wholly or partly overcome the above drawbacks of the prior art and to provide an improved alternative to the above technique.

Generally, it is an object of at least some of the embodiments of the present disclosure to provide a microwave heating apparatus capable of simultaneously heating several dishes with improved heating evenness.

This and other objects of the present disclosure are achieved by means of a microwave heating apparatus and a method having the features defined in the independent claims.

Hence, according to a first aspect of the present invention, a microwave heating apparatus is provided. The microwave heating apparatus comprises a cavity dividable into at least two compartments, a first microwave generator and a first (or at least one first) feeding port for feeding a first mode field in a first compartment of the cavity, and a second microwave generator and a second (or at least one second) feeding port for feeding a second mode field in a second compartment of the cavity. In the microwave heating apparatus of the present disclosure, the first mode field and the second mode field provide complementary heating patterns in the cavity when the cavity is undivided.

According to a second aspect of the present disclosure, a method of heating a load using microwaves in a cavity dividable into at least two compartments is provided. The method comprises the steps of providing a first mode field suitable for a first compartment of the cavity and providing a second mode field suitable for a second compartment of the cavity. The first and second mode fields provide complementary heating patterns in the cavity when the cavity is undivided.

In the microwave heating apparatus of the present disclosure, if the cavity is divided in at least two compartments (or two cooking rooms or sub-cavities), a first mode field suitable for heating in a first compartment is provided and a second mode field suitable for heating in a second compartment is provided. The present disclosure makes use of an understanding that heating evenness may be obtained if a cavity, or a subpart of the cavity, is adapted to support a specific mode field. The present disclosure provides a microwave heating apparatus with improved heating evenness, without requiring any specific moving/rotating parts or turntables.

The present disclosure provides a microwave heating apparatus in which the size of the cavity may be selected without altering the heating evenness. More specifically, in the microwave heating apparatus of the present disclosure, the first mode field and the second mode field provide two complementary heating patterns when the cavity is undivided. Thus, if the cavity is undivided, a microwave heating apparatus with a large cavity (corresponding to the volume of the first and second compartments) and a suitable heating pattern is provided and, if the cavity is divided, a microwave heating apparatus having a plurality of compartments each having its suitable mode field (and thereby heating pattern) is provided.

The term "complementary" heating patterns, as used herein, is generally to be understood in its ordinary meaning. Complementary heating patterns serve to fill out each other by mutually supplying each other's lack of heating ability in at least some region of the microwave enclosure(s). The term should be understood in its broadest sense, meaning that two heating patterns are "complementary" if the evenness of the aggregate heating pattern is enhanced compared to the heating pattern of any single one of the two heating patterns alone. For example, a first heating pattern resulting from the first mode field may exhibit cold spots in one or more regions of the cavity, and a second heating pattern resulting from the second mode field may exhibit hot spots overlapping said cold spots, meaning that the first and the second heating patterns are complementary by providing an aggregate heating pattern having enhanced evenness compared to each of the first and second heating patterns alone. It should also be understood that hot and cold spots are "hot" and "cold" compared to each other and not necessarily in an absolute sense, such that also a "cold" spot may provide some heating ability. Complementary heating patterns will then supplement each other for an overall improved heating efficiency.

As compared to prior art devices in which the cavity or heating/cooking chamber is not dividable, the microwave heating apparatus of the present disclosure is more flexible in that it offers the possibility of heating a plurality of food items in a large cavity or in their respective compartments of the cavity. It is also possible to heat a single food item (or single piece of food) in the large cavity or in one of the compartments of the cavity.

The present disclosure provides the possibility of dual level heating of food when the cavity is divided. When the cavity is divided, the customer has a microwave heating apparatus with two separate cavities fed independently while, when the cavity is not divided, the microwave heating apparatus can be used for e.g. heating of larger loads.

The present disclosure does not require any specific and advanced feeding system. In the microwave heating apparatus, a first microwave generator and a first feeding port (associated with the first microwave generator) are provided for feeding the first mode field while a second microwave generator and a second feeding port (associated with the second microwave generator) are provided for feeding the second mode field. In other words, a microwave generator and a feeding port are dedicated for each one of the mode fields.

According to an embodiment, the microwave heating apparatus may comprise holding means (or supporting/fixation means) configured to hold/support at least one partitioning means (such as a shelf or plate) for partitioning the cavity in two compartments. In for example a rectangular cavity, the holding means may be positioned at the side walls of the cavity (i.e. the walls located on the left- and right-hand sides when opening the cavity/oven) but may also be positioned at the rear wall of the cavity (i.e. the wall opposite to the wall at which a door of the microwave heating apparatus is arranged). The cavity may also have a circular shape, in which case the holding means may be positioned at a number of positions at the circumference of the interior wall of the cavity. It will also be appreciated that the microwave heating apparatus may be dividable into more than two compartments and, in that case, the cavity would be equipped with supporting means adapted to support more than only one partitioning means or shelf (or equipped with a plurality of separate supporting means).

According to an embodiment, the microwave heating apparatus may comprise at least one removable partitioning means (e.g. a shelf), which provides the flexibility for a customer of operating the microwave heating apparatus with two (sub)cavities or compartments (or more than two if a plurality of shelves can be installed in the cavity) or with a single cavity larger than each one the two compartments. The detachable shelf acts as a partitioning means defining the compartments in the cavity.

In particular, the removable shelf may include a choke sealing along at least one of its edges, thereby preventing transmission of microwaves from one compartment to another. The present embodiment provides an increased control of the heating pattern in each of the compartments, thereby further enhancing the heating evenness in each one of the compartments. Several possible designs for providing such a choke sealing will be described in more detail in the following detailed description. The shelf may include metal.

Further, the shelf may include a dielectric plate for supporting a load or food item to be heated in the cavity. The present embodiment may not directly position the load on the metal part of the shelf (or metal divider). The dielectric plate may be made of e.g. glass or ceramic and arranged at the surface of the metal divider. The dielectric plate provides a certain distance between the load and the metal divider, thereby providing a more efficient heating of the load. In other words, the removable shelf includes a metal divider with an incorporated dielectric plate.

Depending on the intended configuration and design of the microwave heating apparatus, the removable partitioning means (or shelf) may be horizontally or vertically arranged in the cavity. Both configurations may be envisaged in the present disclosure. As most dishes usually extend laterally (i.e. in a horizontal plane) rather than vertically, it is however often preferable to provide a removable shelf which can be horizontally arranged in the cavity. For dishes occupying more space in a vertical direction, the other configuration may be selected, i.e. with a removable partitioning means which can be vertically arranged in the cavity.

If the shelf is horizontally arranged in the cavity, two vertically adjacent compartments are provided (one on top of the other) while, if the partitioning means is vertically arranged, two horizontally adjacent compartments are provided (side by side).

According to an embodiment, the first and second generators may be independently operable, thereby providing flexibility in operation of the microwave heating apparatus. A number of operating modes may then be envisaged.

In a first example, wherein the cavity is undivided, the cavity may be fed with microwaves originating from either one of the first and second microwave generators or from both. Although three basic types of regulation are then possible in the present example, it is preferable to operate the microwave heating apparatus using both microwave generators since the first mode field and the second mode field provide complementary heating patterns, thereby providing a higher heating efficiency than if just one of the microwave generators is operated. However, the selection of the operating mode will be controlled based on the desired heating program. The first and second microwave generators may also be regulated using different operating parameters (such as the frequency, phase and amplitude) for each one of the microwave generators, thereby enabling adjustment of the heating pattern resulting from the first and second mode fields.

In a second example, wherein the cavity is divided in e.g. two compartments, the microwave heating apparatus may be operated such that one of the two microwave generators is turned off and the other microwave generator is turned on. The active microwave generator may be regulated to provide an adequate heating pattern in its corresponding compartment. In a more specific example, the first microwave generator may be turned off, e.g. because the first compartment is empty, and the second microwave generator is operated such that it provides an appropriate heating pattern in the second compartment. Regulation of the second microwave generator may depend on information about the load, which may be detected by means of sensors or for instance be input by a user of the microwave heating apparatus (providing information about e.g. food type, volume, weight and initial state/temperature of the food item), and also on any measurements made in the second compartment during the heating procedure. Such measurements may e.g. be reflection measurements to evaluate the amount of microwaves that is absorbed in the second compartment. The second microwave generator may then be regulated accordingly.

In a third example, wherein the cavity is divided in e.g. two compartments, both microwave generators may be operated, thereby providing heating of food items placed in two different compartments of the cavity of the microwave heating apparatus. Regulation of the microwave generators may depend on information about the load (e.g. food type, volume, weight and initial state/temperature of the food item), which may be detected by means of sensors or input by a user of the microwave heating apparatus, and also on any measurements made in the first and second compartments during the heating procedure. Such measurements may e.g. be reflection measurements to evaluate the amount of microwaves that is absorbed in each of the compartments. As different dishes may be placed in the two compartments, the first and second microwave generators are, independently regulated (depending on the above information).

The microwave generators may in principle be of any type since the arrangement of the feeding ports in the cavity provide for the feeding of a first mode field in the first compartment and the feeding of a second mode field in the second compartment. The first and second microwave generators may therefore be magnetrons. However, for adjustment of the heating patterns resulting from the first and second mode fields in the first and second compartments, respectively, and for adjustment of the heating pattern resulting from the combination of the first and second mode fields in the undivided cavity, the first and second microwave generators may be frequency controllable microwave sources. In particular, the first and second microwave generators may be solid state microwave generators.

Solid state technology for generating microwave power is more flexible than magnetrons and provides excellent heating evenness without any moving parts like e.g. a turntable.

According to yet another embodiment, the microwave source may be a solid-state microwave generator comprising semiconductor elements. The advantages of a solid-state microwave generator comprise the possibility of controlling the frequency of the generated microwaves, controlling the output power of the generator and an inherent narrow-band spectrum.

For the purpose of regulation, the microwave heating apparatus may further comprise a control unit configured to control the frequency, the phase and/or the amplitude of the power from the first and second microwave generators for adjusting the heating patterns provided in the first and second compartments, respectively.

Although the use of solid state microwave generators provides the possibility for adjustment of the heating pattern by regulation of e.g. the frequency, the phase and the amplitude of the power of the microwaves, the cavity is dividable such that the first compartment is designed to support the first mode field and the second compartment is designed to support the second mode field. In other words, the position (within the cavity, e.g. along a sidewall or rear wall) at which any holding means necessary for holding a removable shelf defining the first and second compartments is arranged may be determined such that it results in a first compartment designed to support the first mode field and in a second compartment designed to support the second mode field.

According to an embodiment, the cavity may be dividable vertically in a height direction of the cavity, thereby providing an upper compartment (or upper subcavity) and a lower compartment (or lower subcavity). The present embodiment is an implementation of the disclosure with respect to space management since most dishes usually extend more laterally than vertically. The cavity may then be equipped with holding means for holding a shelf, the holding means being positioned within the cavity (e.g. at a sidewall or the rear wall, or generally any interior wall/inner surface of the cavity) to define the desired upper and lower compartments.

According to an embodiment, at least two feeding ports (i.e. two "first" feeding ports or a pair of first feeding ports) may be positioned to provide the first mode field in an upper compartment of the cavity and at least two other feeding ports (i.e. two "second" feeding ports or a pair of second feeding ports) may be positioned to provide the second mode field in a lower compartment of the cavity. Several examples will be described in more detail in the following, including details about the positioning of any partitioning means (and thus any holding means) along the height direction.

In particular, the holding means may be positioned along a height direction of the cavity at a height determined based on boundary conditions for the first and second mode fields.

It will be appreciated that any of the features in the embodiments described above for the microwave heating apparatus according to the first aspect of the present disclosure may be combined with the method according to the second aspect of the present disclosure.

Further objectives of, features of, and advantages with, the present disclosure will become apparent when studying the following detailed disclosure, the drawings and the appended claims. Those skilled in the art will realize that different features of the present disclosure can be combined to create embodiments other than those described in the following.

BRIEF DESCRIPTION OF THE DRAWINGS

The above, as well as additional objects, features and advantages of the present disclosure, will be better understood through the following illustrative and non-limiting detailed description of embodiments of the present disclosure, with reference to the appended drawings, in which.

Figure 1:
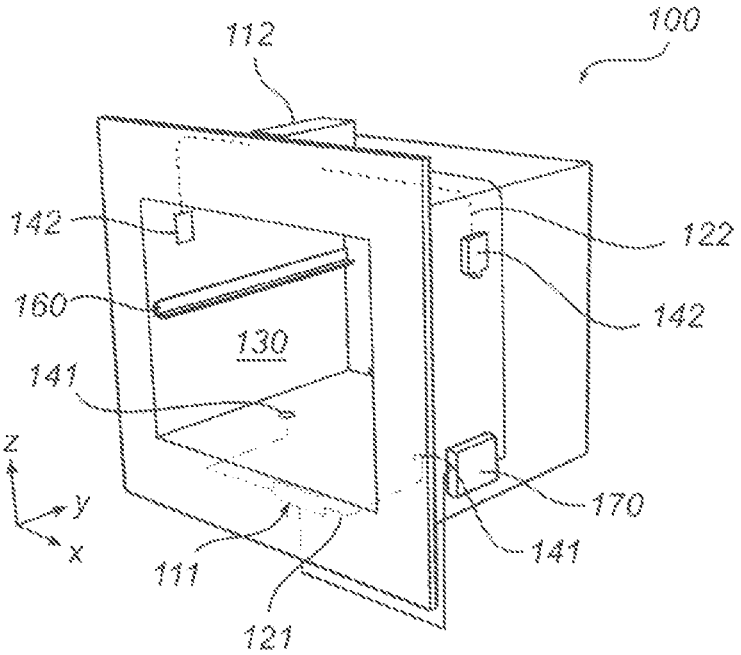
FIG. 1 schematically shows a microwave heating apparatus according to an embodiment of the present disclosure.

All the figures are schematic, not necessarily to scale, and generally only show parts which are necessary in order to elucidate the disclosure, wherein other parts may be omitted or merely suggested.

DETAILED DESCRIPTION

With reference to FIGS. 1 and 2*a*-*c*, there is shown a schematic view of a microwave heating apparatus according to an embodiment of the present disclosure. Various configurations of the microwave heating apparatus are shown in FIGS. 1 and 2*a*-*c*.

The microwave heating apparatus 100 comprises a cavity 130 dividable into at least two compartments 131 and 132. The microwave heating apparatus 100 is equipped with a first microwave generator 111 and a pair of first feeding ports (or feeding points) 141 arranged at the bottom of the cavity 130. The first microwave generator 111 and the first feeding ports 141 are arranged to feed a first mode field suitable for the first compartment 131. The microwave heating apparatus 100 is also equipped with a second microwave generator 112 and a pair of second feeding ports (or feeding points) 142 arranged at the upper part of the side walls of the cavity 130. The second microwave generator 112 and the second feeding ports 142 are arranged to feed a second mode field suitable for the second compartment 132.

For feeding the microwaves from the microwave generators 111 and 112 of the cavity 130, the microwave heating apparatus 100 may also be equipped with transmission lines 121 and 122, respectively. A first transmission line 121 may be arranged between the first microwave generator 111 and the cavity 130 for feeding of microwaves via the first feeding ports 141 and a second transmission line 122 may be arranged between the second microwave generator 112 and the cavity 130 for feeding of microwaves via the second feeding ports 142. The microwave sources 111 and 112 are arranged at the respective first ends, or extremities, of each one of their corresponding transmission lines 121 and 122 while the cavity 130 is arranged at the second ends, opposite to the first ends, of these transmission lines 121 and 122. The first and second microwave sources 111 and 112 are adapted to generate microwaves, e.g. via their respective antennas (not shown), and the transmission lines 121 and 122, respectively, are configured to transmit the generated microwaves from the (antenna of the) microwave sources 111 and 112 to the cavity 130. The transmission lines may be waveguides or coaxial cables.

Each of the microwave sources 111 and 112 is associated with a dedicated feeding port 141 and 142, respectively (and possibly with a dedicated transmission line 121 and 122, respectively) such that the power of the microwaves transmitted from each of the microwave sources 111 and 112 and, optionally, the power of the microwaves reflected to each one of the microwave sources can be separately monitored.

A feeding port may for instance be an antenna, such as a patch antenna or a H-loop antenna, or even an aperture in a wall (including sidewalls, the bottom and the ceiling) of the cavity 130. In the following, reference is made to the term "feeding port".

The cavity 130 of the microwave heating apparatus (or microwave oven) 100 defines an enclosing surface wherein one of the side walls of the cavity 130 may be equipped with a door (not shown in FIG. 1 but the door may suitably be arranged at the open side of the depicted cavity 130) for enabling the introduction of a load, e.g. a food item, in the cavity 130.

The cavity may further comprise holding (supporting) means 160 configured to hold (support) a shelf 150 for partitioning the cavity 130 in two compartments or cooking rooms 131 and 132. The holding means 160 may be made of glass or ceramic while the core of the shelf may be made of metal.

As shown in FIG. 1, the holding means 160 may be arranged at half of the height of the cavity 130, thereby enabling the division of the cavity into two compartments essentially identical in size (or volume). However, as will be further illustrated in the following, the microwave heating apparatus may be equipped with a plurality of holding means 160 such that the cavity may be divided in different manners (e.g. at one third or two third of the height or, in other cases, at one fourth or three fourth of the height), thereby resulting in compartments of different sizes/volumes.

FIG. 1 shows the microwave oven in a configuration wherein the cavity is undivided. In this configuration, a load may be inserted in the cavity 130 via a front door. As the cavity is undivided, a large cavity suitable for heating large loads or food items is provided. The microwave heating apparatus 100 may then be operated by activating both the first and the second microwave generators 111 and 112, the heating pattern resulting from the first mode field provided by the first microwave generator 111 and the first feeding ports 141 being complementary to the heating pattern resulting from the second mode field provided by the second microwave generator 112 and the second feeding ports 142. In the example shown in FIGS. 1 and 2*a-c*, the feeding ports are arranged to provide an orthogonal feeding of the microwaves in the undivided cavity.

The shelf 150 is removable or detachable such that the user can choose between operation of the microwave oven 100 with a large cavity 130 or with two separate cavities (or cooking rooms) 131 and 132.

In general, the number and/or type of available mode fields in a cavity or a compartment of a cavity are determined by the design of the cavity (or the compartment). The design of a cavity (compartment) comprises the physical dimensions of the cavity (compartment) and the location of the feeding port(s) in the cavity (compartment). The dimensions of the cavity are generally provided by the height (h), depth (d) and width (w) using a coordinate system (x, y, z), such as shown in FIGS. 1, 2*a*-2*c* and 3. The height h corresponds to the dimension along the z-axis, the depth d corresponds to the dimension along the y-axis and the width corresponds to the dimension along the x-axis. Further, when designing a cavity of a microwave heating device, the impedance mismatch created between any transmission line and the cavity is preferably taken into account. For this purpose, the length of the transmission lines may also be slightly adjusted and the dimensions of the cavity tuned accordingly. During the tuning procedure, a load simulating a typical load to be arranged in the cavity may be present in the cavity (or compartments). In addition, the tuning may be accomplished via local impedance adjustments, e.g., by introduction of a tuning element (such as a capacitive post) arranged in the transmission line or in the cavity, adjacent to the feeding port.

Figure 2A:
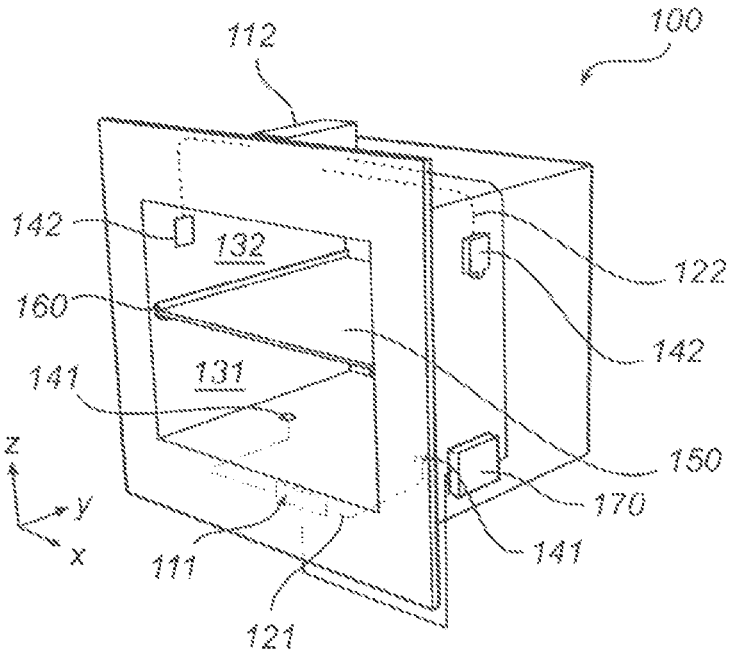
FIGS. 2*a*-2*c* schematically shows a microwave heating apparatus similar to the microwave heating apparatus shown in FIG. 1 but according to other configurations.
Figure 2B:
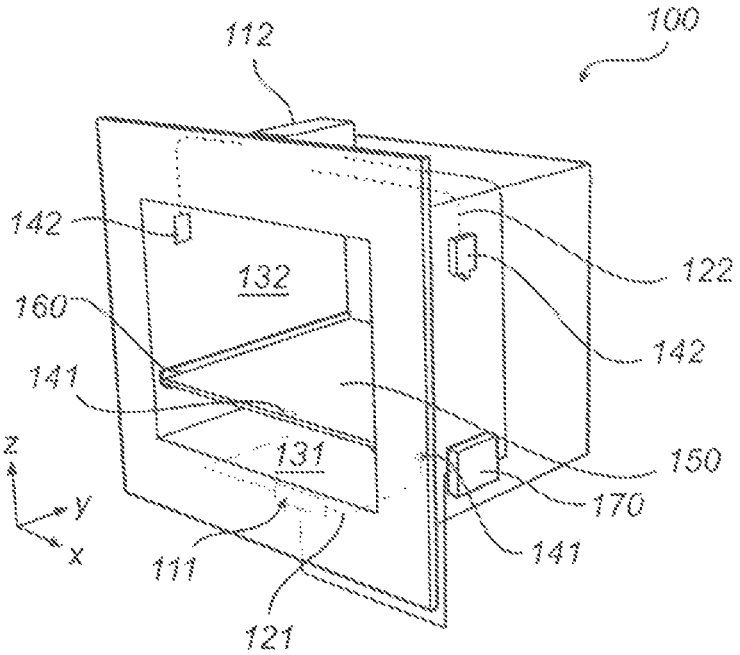
Figure 2C:
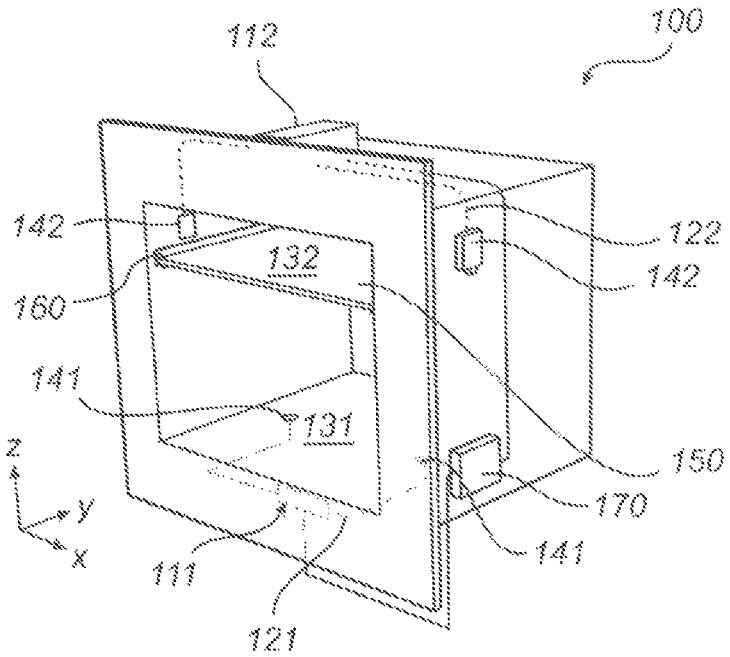

In the present example, the cavity is designed to have a rectangular shape with a width of 470 mm (dimension along the x-axis), a depth of 400 mm (dimension along the y-axis) and a height of 400 mm (dimension along the z-axis). In this configuration, wherein the cavity is dividable into two compartments arranged adjacent to each other in a vertical direction (z-axis), the height of the cavity is selected to provide a volume sufficient for placing a food item in each one of the compartments. As illustrated in FIGS. 2*a*-2*c*, the cavity may be equipped with a plurality of holding means 260 such that the size of each one of the compartments may be customized. The shelf or divider plate 150 may be inserted at different height levels within the cavity. The customer may then choose a configuration providing a reasonable volume in each one of the compartments when the divider plate is inserted in the cavity 130.

The feeding ports 141 and 142 may be arranged at, in principle, any walls of the cavity 130. However, there is generally an optimized location of the feeding ports for a predefined mode. In the present example, the two modes $TM_{614}$ and $TM_{534}$ with even height index are considered in order to launch a complementary field pattern in the cavity 130 when it is undivided (i.e. without any shelf 150 inserted in the cavity 130 as shown in FIG. 1). For exciting these two modes in the cavity 130, two first feeding ports 141 are positioned at the bottom of the cavity 130 (z=0) to launch mode $TM_{614}$ and another two feeding ports 142 (or pair of second feeding ports 142) are located at the side walls in the upper part of the cavity, one second feeding port 142 located on the right hand-side wall and another one second feeding port 142 located on the left hand-side wall, as shown in e.g. FIG. 1 (at x=0 and x=w), in order to launch mode $TM_{534}$. The pair of second feeding ports 142 is separated to the left and right side walls and face each other at the upper half of the cavity 130. When the microwave appliance 100 is operated without any divider plate 150, i.e. when it is operated as shown in FIG. 1, the microwaves from the four feeding ports launch both modes resulting in a complementary heating pattern, which provides an even heating in the cavity 130.

When the divider plate 150 is inserted at a height determined by the boundary conditions for the aforementioned modes, two compartments 131 and 132 may be realized. As schematically shown in FIGS. 2*a-c*, in the present example, the shelf may be arranged at half (z=h/2) or one fourth (z=h/4) of the cavity height h. The width w and depth d of the two compartments 131 and 132 are the same as the width w and depth d of the cavity 130 (i.e. without the divider plate 150), while the height h of the two compartments are approximately half the cavity height, as shown in FIG. 2*a*, or one quarter and three quarter of the cavity height for the two compartments, as shown in FIGS. 2*b* and 2*c*. Thus, the mode width index and depth index are maintained while the mode height index in the compartments is half the one in the cavity for the configuration shown in FIG. 2*a* (i.e. with the divider plate inserted at half of the cavity height), and split into height indexes 1 and 3 for the configurations shown in FIGS. 2*b-c*. Referring first to the configuration depicted in FIG. 2*a*, the upper compartment 132 is fed by the two upper feeding ports 142 to couple the mode $TM_{532}$ while the lower compartment 131 is fed by the two bottom feeding ports 141 to couple the mode $TM_{612}$. Analogously, referring to the configuration depicted in FIG. 2*b*, the upper compartment 132 is fed by the two upper feeding ports 142 to couple the mode $TM_{533}$ while the lower compartment 131 is fed by the two bottom feeding ports 141 to couple the mode $TM_{611}$ and, referring to the configuration depicted in FIG. 2*c*, the upper compartment 132 is fed by the two upper feeding ports 142 to couple the mode $TM_{531}$ while the lower compartment 131 is fed by the two bottom feeding ports 141 to couple the mode $TM_{613}$. Via the positioning of the holding means 160 at the inner walls of the cavity 130, the two compartments 131 and 132 (obtained after insertion of a shelf 150 on the holding means 160) are designed to support two specific (and different) mode fields. As a result, an even heating in the two compartments 131 and 132 is obtained.

According to yet a further embodiment, the microwave generators 111 and 112 may be solid-state microwave generators including e.g. a varactor diode (having a voltage-controlled capacitance). Solid-state based microwave generators may, for instance, comprise silicon carbide (SiC) or gallium nitride (GaN) components. Other semiconductor components may also be adapted to constitute the microwave sources 111 and 112. In addition to the possibility of controlling the frequency of the generated microwaves, the advantages of a solid-state based microwave generator comprise the possibility of controlling the output power level of the generator and an inherent narrow-band feature. The frequencies of the microwaves that are emitted from a solid-state based generator usually constitute a narrow range of frequencies such as 2.4 to 2.5 GHz. However, the present disclosure is not limited to such a range of frequencies and the solid-state based microwave sources could be adapted to emit in a range centered at 915 MHz, for instance 875-955 MHz, or any other suitable range of frequency (or bandwidth). The embodiments described herein are for instance applicable for standard sources having mid-band frequencies of 915 MHz, 2450 MHz, 5800 MHz and 22.125 GHz. Alternatively, the microwave sources 111 and 112 may be frequency-controllable magnetrons such as disclosed in document GB2425415.

The use of solid state microwave generator or frequency-controllable microwave sources provides a homogeneous cooking without the need of moving parts when dividing the cavity into two compartments using a metallic divider shelf. Preferably, the amplitude, the frequency and the phase of the microwaves emitted from the microwave generators may be adjusted. Adjustment of the aforementioned parameters in the power supplies will affect the resulting heating patterns, thereby providing the possibility of improving the heating evenness in the compartments.

For the purpose of regulation, the microwave heating apparatus may further comprise a control unit 170 configured to control the frequency, the phase and/or the amplitude of the power from the first and second microwave generators 111 and 112 for adjusting the heating patterns provided in the first and second compartments 131 and 132, respectively. The first and second microwave generators 111 and 112 are independently controlled and independently operable.

Still for the purpose of regulation, the control unit may be configured to receive information about measurements of the amount of microwaves reflected from the compartments 131 and 132 (or from the cavity 130).

In another example, a cavity with a width w of 500 mm, a depth d of 470 mm and a height h of 460 mm is considered together with mode fields having an odd height index of 5. The cavity may then be suitable for launching the mode $TM_{615}$. The divider plate 150 could for example be inserted at two fifths (2/5) or three fifths (3/5) of the cavity height.

Figure 3:
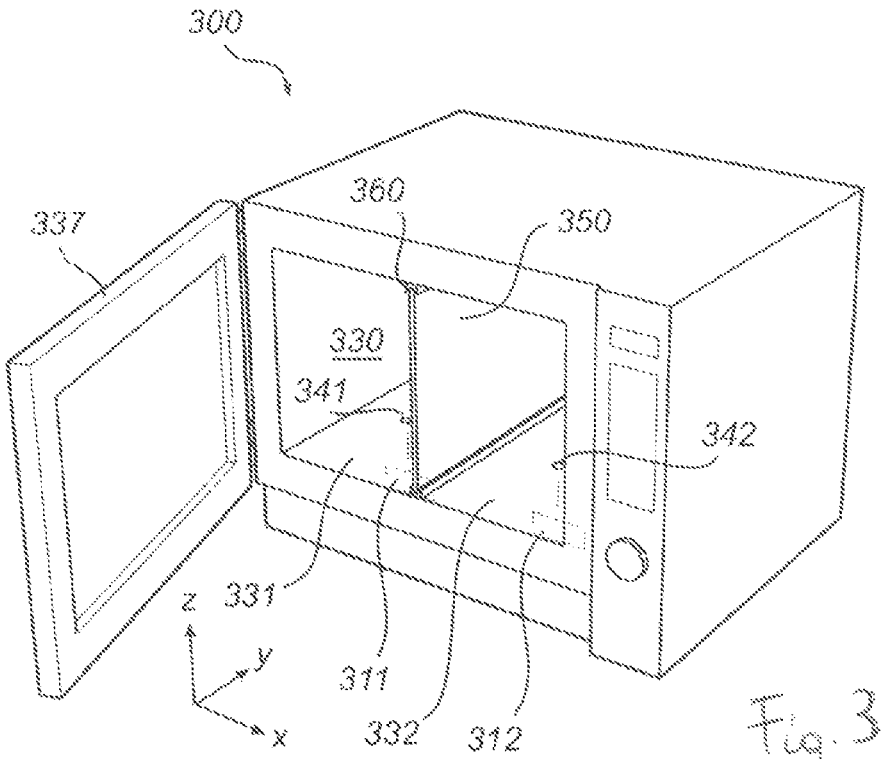
FIG. 3 schematically shows a microwave heating apparatus according to yet another embodiment of the present disclosure.

With reference to FIG. 3, there is shown a microwave heating apparatus 300, e.g. a microwave oven, having features according to another embodiment of the present disclosure.

The microwave heating device 300 is similar to the microwave heating device 100 described with reference to FIGS. 1 and 2*a*-2*c* except that the cavity is dividable horizontally in a lateral direction of the cavity (here along the x-axis). The partitioning means or removable shelf 350 may therefore be vertically arranged in the cavity 330.

In analogy with the examples described in connection to FIGS. 1 and 2*a-c*, the partitioning means 350 is positioned such that the first compartment 331 (on the left hand-side in FIG. 3) is arranged to support a first mode field and the second compartment 332 (on the right hand-side in FIG. 3) is arranged to support a second mode field. For this purpose, the cavity is provided with holding means 360 arranged to hold the partitioning means 350 vertically in the cavity 330. The whole cavity, i.e. without the partitioning means 350, is then designed to support both the first and the second mode fields providing complementary heating patterns.

FIG. 3 illustrates also a microwave oven equipped with a door 337 arranged at one side of the cavity 330 for enabling the introduction of food items in the cavity 330 or compartments 331 and 332. Each one of the compartments 331 and 332 is provided with its respective feeding port 341 and 342 connected to two microwave generators 311 and 312, respectively. According to an embodiment, automatic detection of whether a divider plate is inserted in the cavity may be provided. For this purpose, the control unit may be configured to receive information from a sensor arranged in the cavity. Such a sensor may for example be a weight sensor configured to detect the presence of the divider plate on the holding means. The control unit may then be configured to operate the microwave oven with a single cavity (if no divider plate is detected) or with two compartments/sub-cavities (if a divider plate is detected) and then run the heating procedure/program accordingly. Such information may also be input by a user via entry means (display, button) such as represented on the microwave oven shown in FIG. 3.

With reference to FIGS. 4-8, various configurations/designs of removable shelves in accordance with several embodiments of the present disclosure are described.

It will be appreciated that each one of FIGS. 4-8 does not show a whole shelf but rather a portion of it, which portion is adjacent to a side wall of the cavity (in the figures the portion adjacent to the left wall of the cavity is shown). The figures therefore also show the holding/supporting means on which the shelf is intended to lie when it is inserted in the cavity.

The core of each one of the shelves depicted in FIGS. 4-8 may be made of metal. Further, a removable shelf may include a choke sealing along at least one of its edges, in particular along the edge intended to be arranged at a side wall of the cavity. The removable shelf acts as a support for any food item to be heated or reheated in the compartment defined above the removable shelf and also as a means for preventing transmission of microwaves between two adjacent compartments.

FIGS. 4-8 show various configurations/designs providing various degrees of attenuation of the transmission of microwaves from one compartment to another. From FIGS. 4 to 8, the configurations of shelves provide an increased degree of attenuation.

Although the various designs of the following shelves or partitioning means are provided for the purpose of illustration in the present application, any subject-matter related to these designs may be the subject of separate divisional applications. In other words, separate divisional applications may be directed towards one or a plurality of the inventive shelves or partitioning means described herein.

Figure 4:
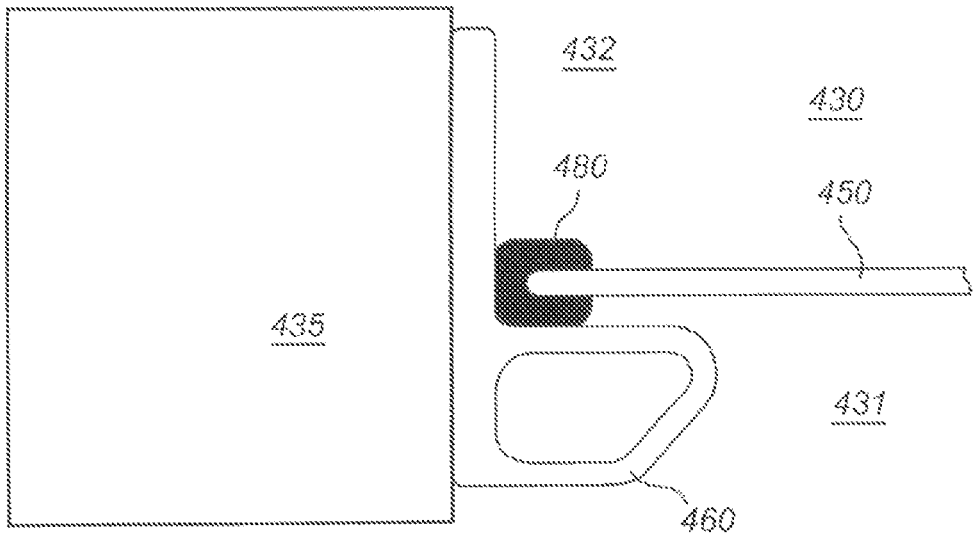
FIGS. 4-8 show various configurations/designs of a removable shelf in accordance with several embodiments of the present disclosure.

Referring first to FIG. 4, the divider plate 450 may be inserted in a block 480 comprising a rail or groove having a width corresponding to, or being at least slightly larger than, the thickness of the divider plate 450. In the present configuration, the divider plate 450 is an essentially flat rectangular plate with (standard) straight edges, i.e. without any particular features at its outer boundaries. The block 480 may be made of a dielectric material such as ceramic, plastic or rubber (e.g. silicone) and is arranged on a supporting means 460 attached to a side wall 435 of a cavity 430. The opening or groove made in the block 480 faces the inside of the cavity 430 such that the divider plate 450 may be inserted in the block 480. In comparison to the configurations described in the following, such configuration provides a rather low degree of attenuation of the transmission of microwaves between a lower compartment 431 formed below the shelf 450 and an upper compartment 432 formed above the shelf 450 in the cavity 430.

Figure 5:
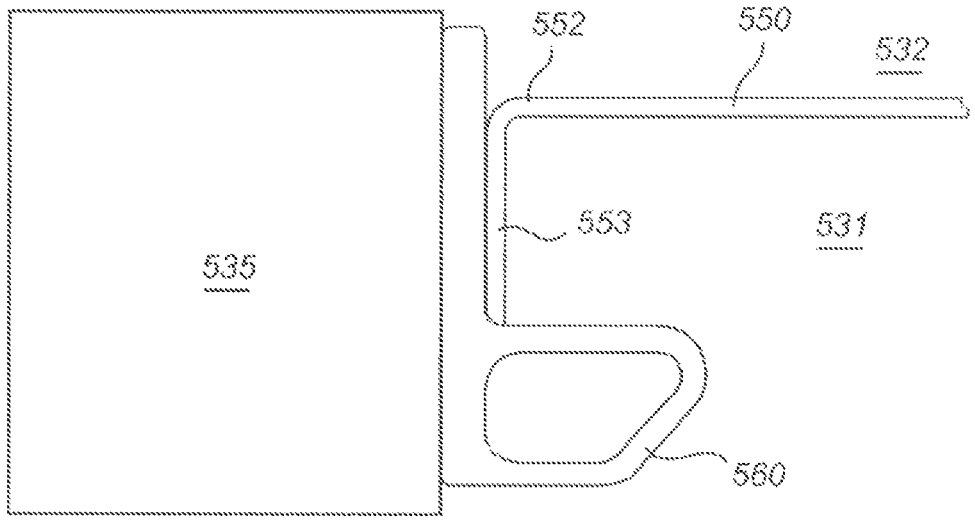

Turning now to FIG. 5, the divider plate 550 may be configured to be directly arranged on the holding means 560, i.e. without any block. The divider plate 550 is an essentially flat rectangular plate which extends perpendicularly at its edge or outer boundary 552. In other words, the shelf or divider plate 550 includes an outer boundary 552 and a downturned end 553 defining a gap between the upper flat portion of the divider plate 550 and the holding means 560. The size of the gap is defined by the length of the downturned end 553. The size or width of the divider plate 550 is selected such that the downturned end 553 is arranged adjacent to, or at least nearby, the side wall 535 of the cavity 530. When the divider plate 550 is inserted, a lower compartment 531 is formed below the shelf 550 and an upper compartment 532 is formed above the shelf 550. In comparison to the other designs shown in FIGS. 4 and 6-8, such a configuration provides a medium attenuation of the microwave transmission between the upper and lower compartments 531 and 532. In other words, the design depicted in FIG. 5 provides a higher degree of attenuation than the configuration shown in FIG. 4 but a lower degree of attenuation as compared to the designs shown in FIGS. 6-8.

Figure 6:
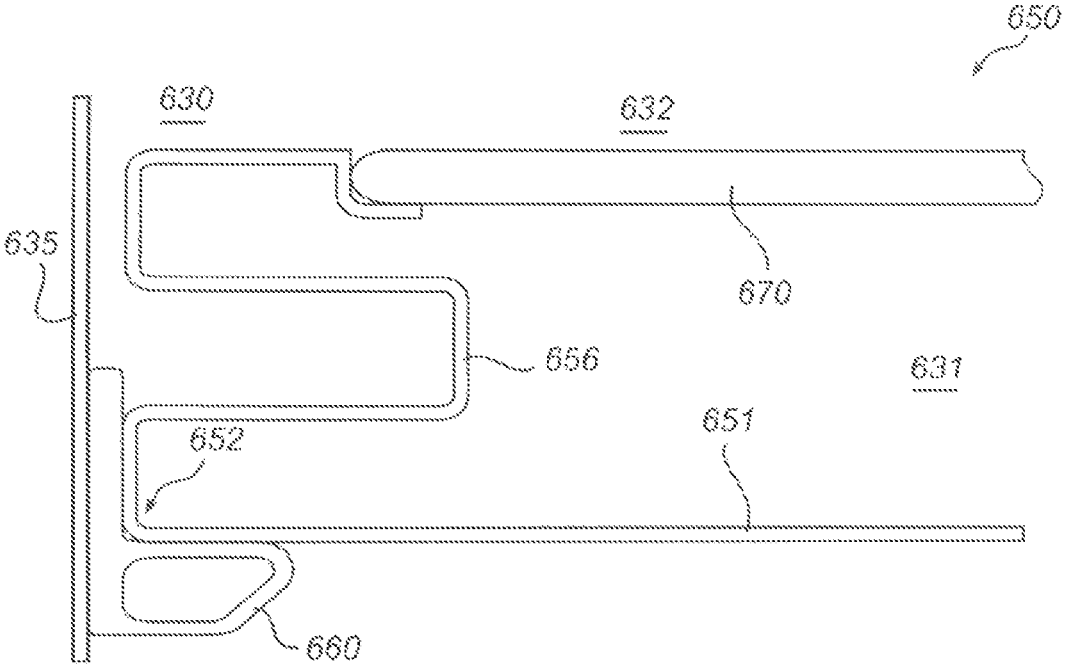
Figure 7:
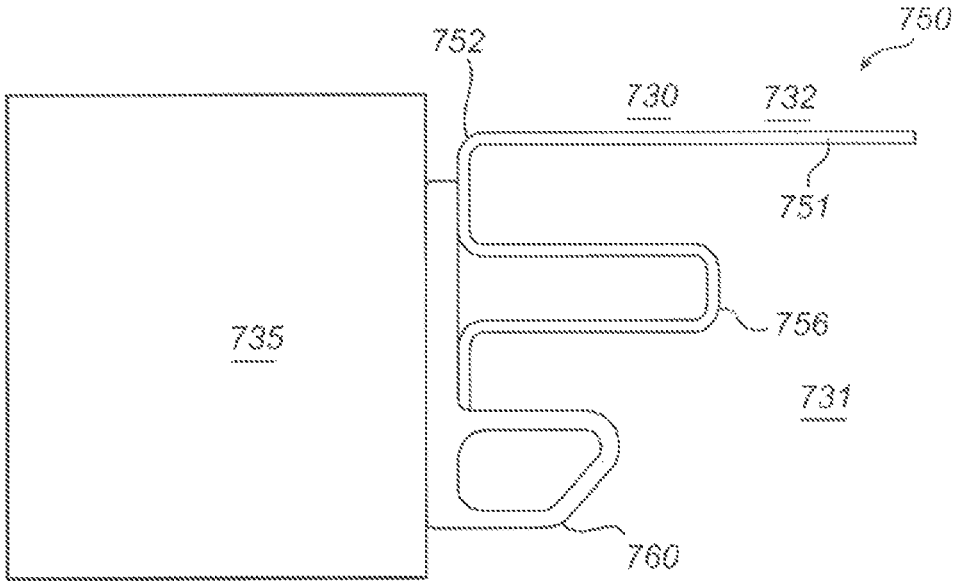
Figure 8:
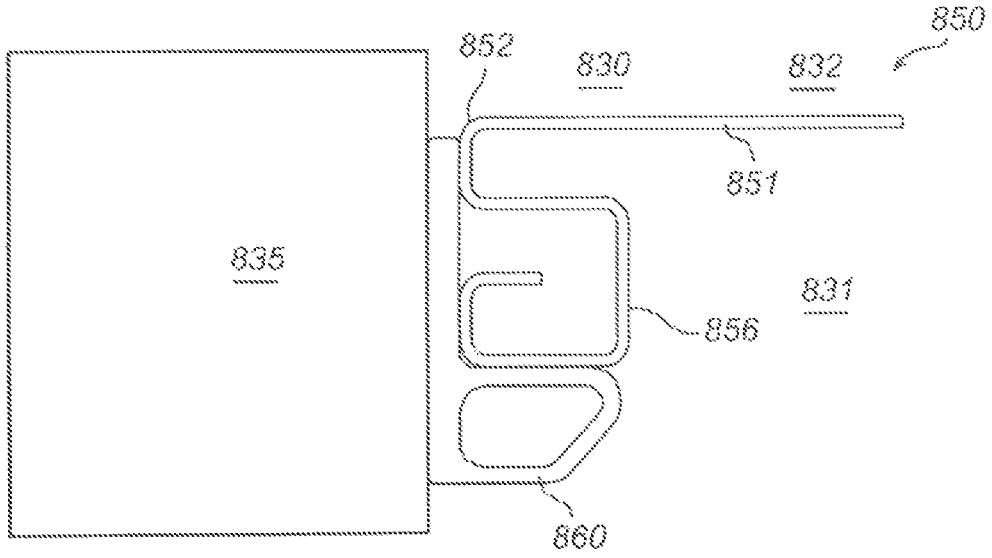

Turning now to FIGS. 6-8, three more possible designs for a removable shelf are described. These three designs provide a rather high degree of attenuation of microwave transmission between the compartments, as defined after insertion of the shelf into a cavity, and in particular a higher degree of attenuation than that provided by the designs shown in FIGS. 4 and 5.

FIGS. 6-8 have in common that the edge or outer boundary of the divider shelf ends with a serpentine (i.e. having a form or shape resembling a moving snake/serpent or at least some kind of S-shaped edge).

Referring in particular to FIG. 6, a main portion 651 of a divider plate 650 is an essentially flat rectangular plate which, at its outer boundary 652, ends up with an upwardly extending serpentine 656. More specifically, the serpentine 656 comprises a succession (or sequence) of first and second portions, wherein a first portion extends upwardly from, and perpendicularly to, the main portion 651 of the divider plate 650 and wherein a second portion extends (alternatively) either inwardly (i.e. in direction to the inside of the cavity) or outwardly (i.e. in direction to the side wall) from, and substantially parallel to (as shown in FIG. 6 although this is not necessary), the main portion 651 of the divider plate 650. In the example depicted in FIG. 6, the size of the main portion 651 of the divider plate 650 is selected such that the first (upwardly extending) portion of the serpentine extends along the side wall 635 of the cavity 630. Thus, in the present example, the main portion 651 of the divider plate 650 is intended to directly lie on the supporting means 660 attached to the side wall 635 of the cavity 630. Further, in the present example, the serpentine 656 of the divider plate 650 comprises six portions (i.e. three of the above mentioned sequences of portions), thereby having almost an S-shape, wherein the sixth portion ends up with some kind of free-ending recession on which a dielectric plate 670 may lie. Thus, the dielectric plate 670 lies on an edge of the serpentine 656 and the shelf 650 comprises a gap between the main portion 651 of the divider plate 650 and the dielectric plate 670 due to the serpentine 656 arranged between them. The dielectric plate 670 is suitable for holding a recipient in which a food item is located. When the divider plate (or shelf) 650 is inserted, a lower compartment 631 is formed below the shelf 650 and an upper compartment 632 is formed above the shelf 650.

FIGS. 7-8 show two other alternatives, wherein the main portions 751 and 851 of the divider plates (or shelves) 750 and 850 are essentially flat rectangular plates which, at their respective outer boundaries 752 and 852, end up with downwardly extending serpentines 756 and 856, respectively. The two serpentines 756 and 856 may also be secured to the undersurfaces of the main portions 751 and 851 of the divider plates 750 and 850, respectively. The serpentines may be defined in a similar manner as for the serpentine shown in FIG. 6, i.e. as a succession (or sequence) of first and second portions except that, in these examples, the first portions extend downwardly, instead of upwardly, from the main portion of the divider plate. In the examples depicted in FIGS. 7 and 8, the size of the main portions 751 and 851 are selected such that the first portion of each one the serpentines 756 and 856 extends downwardly along the side walls 735 and 835, respectively, of the cavities 730 and 830. Thus, in these examples, the main portions 751 and 851 of the divider plates 750 and 850 are not intended to directly lie on the supporting means 760 and 860 attached to the side walls 735 and 835 of the cavities 730 and 830 but, instead, the serpentines 756 and 856 are configured to lie on these supporting means.

In the design depicted in FIG. 7, the serpentine 756 of the divider plate 750 comprises five portions, wherein the fifth portion (counted from the beginning of the serpentine or outer boundary 752) is a downwardly extending portion ending up on the supporting means 760. The serpentine 756 provides a certain distance (or gap) between the main portion 751 of the divider plate 750 and the holding means 760. When the shelf 750 is inserted in the cavity 730, a lower compartment 731 is formed below the shelf 750 and an upper compartment 732 is formed above the shelf 750.

In the design depicted in FIG. 8, the serpentine 856 of the divider plate 850 comprises six portions; however, the fourth portion (counted from the beginning of the serpentine or outer boundary 852) extends horizontally towards the sidewall 835 of the cavity 830 and is intended to lie on the holding means 860 while the fifth portion extends upwardly towards the beginning of the serpentine. The sixth portion extends horizontally from the fifth portion towards the inside of the cavity 830. The serpentine 856 provides a certain distance (or gap) between the main portion 851 of the divider plate 850 and the holding means 860. When the shelf 850 is inserted in the cavity 830, a lower compartment 831 is formed below the shelf 850 and an upper compartment 832 is formed above the shelf 850.

Figure 9:
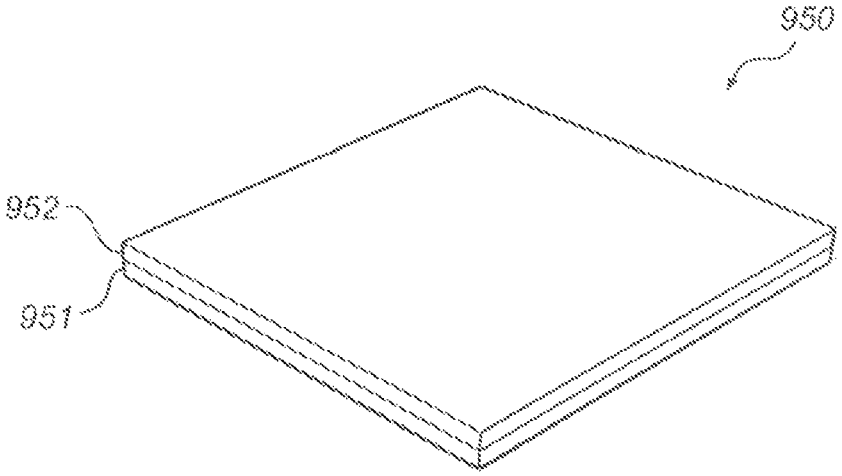
FIG. 9 shows the construction of a removable shelf according to an embodiment of the present disclosure.

With reference to FIG. 9, the construction of a removable shelf according to an embodiment of the present disclosure is described.

FIG. 9 shows a shelf 950 which may include two parts, a first part or layer (sheet) 951 corresponding to the divider plate itself, which may be made of metal, and a second part or layer (sheet) 952 including a dielectric plate for supporting a load. The dielectric plate may include glass or ceramic. The dielectric plate 952 is suitable for holding a recipient in which a food item is located. In the present embodiment, a dielectric plate is incorporated to the divider plate. The present embodiment may be combined with the designs shown in FIGS. 4, 5, 7 and 8.

Figure 10:
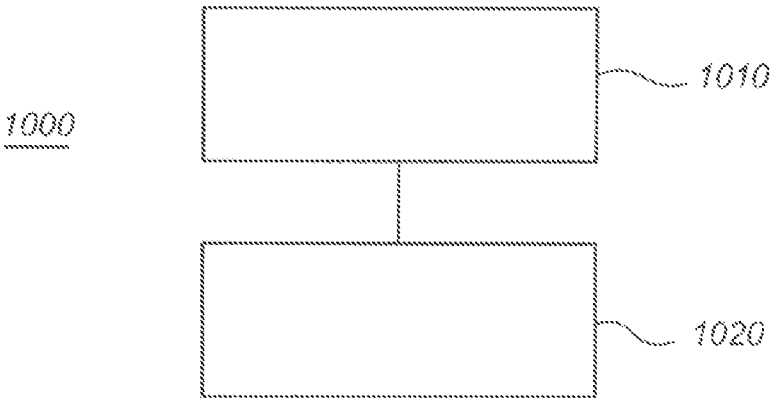
FIG. 10 is a general outline of a method of operating a microwave heating apparatus in accordance with an embodiment of the present disclosure.

With reference to FIG. 10, a method of heating a load using microwaves in a cavity dividable into at least two compartments is described in accordance with an embodiment of the present disclosure. The same reference numbers as for the features of the microwave heating apparatus described with reference to FIG. 1 are used in the following.

The method comprises the step 1010 of providing a first mode field suitable for a first compartment 131 of the cavity 130. The method then also comprises the step of providing a second mode field suitable for a second compartment 132 of the cavity 130. The first and the second mode fields provide complementary heating patterns in the cavity when the cavity is undivided.

Further, it will be appreciated that any one of the embodiments described above with reference to FIGS. 1-9 is combinable and applicable to the method described herein with reference to FIG. 10.

The present disclosure is applicable for domestic appliances such as a microwave oven using microwaves for heating. The present disclosure is also applicable for larger industrial appliances found in e.g. food operation. The present disclosure is also applicable for vending machines or any other dedicated applicators.

While specific embodiments have been described, the skilled person will understand that various modifications and alterations are conceivable within the scope as defined in the appended claims.

For example, although the microwave ovens 100 and 300 described with reference to FIGS. 1, 2*a-c* and 3 have a rectangular enclosing surface, it will be appreciated that, in the present disclosure, the cavity of the microwave oven is not limited to such a shape and may, for instance, have a circular cross section. Consequently, although the shelves or partitioning means described in the present application have a rectangular shape, it will be appreciated that such shelves or partitioning means may have other shapes adapted to the shape of the inside of the cavity into which such shelves are intended to be inserted.

The invention claimed is:

1. A microwave heating apparatus comprising:

a cavity dividable into at least a first compartment for heating a first meal in the first compartment and a second compartment for heating a second meal in the second compartment, each of the first and second compartments having selectable dimensions, and having a set of divider holding means configured to receive and position a divider at different heights in the cavity;

a first microwave generator and a pair of first feeding ports coupled to the first microwave generator to feed a first mode field in the first compartment of said cavity; and a second microwave generator operable independently from the first microwave generator and a pair of second feeding ports coupled to the second microwave generator to feed a second mode field in the second compartment of said cavity;

wherein the microwave heating apparatus is operable to feed the cavity with the first mode field from the first microwave generator, the second mode field from the second microwave generator, and both the first mode field from the first microwave generator and the second mode field from the second microwave generator simultaneously;

wherein when the cavity is divided the heating apparatus is configured to independently heat the first meal from the first mode field and the second meal from the second mode field, and when the cavity is divided, at least one of the divider holding means or divider attenuates transmission of the first mode field to the second compartment and the second mode field to the first compartment; and wherein the pair of first feeding ports and the pair of second feeding ports are arranged such that the first and second mode fields provide complementary heating patterns in the cavity when the cavity is undivided.

2. The microwave heating apparatus of claim 1, wherein the set of divider holding means is configured to hold the divider for partitioning the cavity into said first and second compartments.

3. The microwave heating apparatus of claim 1, wherein the divider includes at least one edge configured with a seal.

4. The microwave heating apparatus of claim 3, wherein said divider is horizontally arranged in said cavity.

5. The microwave heating apparatus of claim 3 wherein the seal comprises a dielectric material.

6. The microwave heating apparatus of claim 1, wherein the divider includes a dielectric plate for supporting a load.

7. The microwave heating apparatus of claim 1, further comprising a control unit configured to control at least one of the frequency, the phase, and the amplitude of the power from the first and second microwave generators.

8. The microwave heating apparatus of claim 1, wherein said first and second microwave generators are frequency-controllable microwave sources.

9. The microwave heating apparatus of claim 1, wherein said first and second microwave generators are solid state microwave generators.

10. The microwave heating apparatus of claim 1, wherein the cavity is dividable vertically in a height direction of the cavity.

11. The microwave heating apparatus of claim 1, wherein the first compartment is a lower compartment of the cavity, and the second compartment is an upper compartment of the cavity, wherein the pair of first feeding ports is positioned to provide the first mode field in the lower compartment of the cavity and the pair of second feeding ports is positioned to provide the second mode field in the upper compartment of the cavity.

12. The microwave heating apparatus of claim 11, wherein the pair of second feeding ports is positioned at opposing side walls and face each other at the upper compartment of the cavity.

13. The microwave heating apparatus of claim 1, wherein the set of holding means is positioned along a height direction of the cavity at a height determined based on a boundary condition for the first and second mode fields.

14. The microwave heating apparatus of claim 1, wherein the divider includes a serpentine at an edge thereof.

15. The microwave heating apparatus of claim 14 wherein the serpentine extends upwardly relative to the cavity.

16. The microwave heating apparatus of claim 14 wherein the serpentine extends downwardly relative to the cavity.

17. The microwave heating apparatus of claim 1 further comprising a first frequency of the first microwave generator and a second frequency of the second microwave generator, wherein each of the first and second frequencies occur at one of 915 MHz or 2450 MHz or 5800 MHz or 22.125 GHz.

18. A microwave heating apparatus comprising:

a cavity dividable into at least a first compartment for heating a first meal in the first compartment and a second compartment for heating a second meal in the second compartment, each of the first and second compartments having selectable dimensions;

a set of divider holding means configured to receive and position at least one removable partition at different heights in the cavity;

a first microwave generator and a pair of first feeding ports coupled to the first microwave generator to feed a first mode field in the first compartment of said cavity; and a second microwave generator operable independently from the first microwave generator and a pair of second feeding ports coupled to the second microwave generator to feed a second mode field in the second compartment of said cavity;

wherein when the cavity is divided by the at least one removable partition, the heating apparatus is configured to simultaneously heat the first meal from only the first mode field and the second meal from only the second mode field, and when the cavity is divided, at least one of the divider holding means or divider attenuates transmission of the first mode field to the second compartment and the second mode field to the first compartment; and wherein the pair of first feeding ports and the pair of second feeding ports are arranged such that the first and second mode fields provide complementary heating patterns in the cavity when the cavity is undivided.

19. The microwave heating apparatus of claim 18 wherein the cavity is divided when the at least one removable partition is received by the cavity and wherein the cavity is undivided when the at least one removable partition is removed from the cavity.

* * * * *